United States Patent [19]

McCarty

[11] 4,024,722

[45] May 24, 1977

[54] HEAT PUMP FROST CONTROL SYSTEM

[75] Inventor: William J. McCarty, Louisville, Ky.

[73] Assignee: General Electric Company, Louisville, Ky.

[22] Filed: May 6, 1976

[21] Appl. No.: 683,882

[52] U.S. Cl. ..... 62/81; 62/156; 62/160; 62/324

[51] Int. Cl.[2] ..... F25B 41/00; F25D 21/06; F25B 13/00

[58] Field of Search ..... 62/81, 156, 159, 160, 62/228, 324; 165/28, 29

[56] References Cited

UNITED STATES PATENTS

| | | | |
|---|---|---|---|
| 3,126,712 | 3/1964 | Gebert | 62/81 |
| 3,131,549 | 5/1964 | Rhea | 62/228 |
| 3,132,490 | 5/1964 | Schmidt | 62/81 |
| 3,159,981 | 12/1964 | Huskey | 62/156 |
| 3,348,607 | 10/1967 | Cootey | 165/28 |
| 3,447,335 | 6/1969 | Ruff et al. | 62/159 |
| 3,466,888 | 9/1969 | Kyle | 62/156 |
| 3,474,639 | 10/1969 | Smith | 62/160 |
| 3,529,659 | 9/1970 | Trask | 165/29 |
| 3,638,444 | 2/1972 | Lindahl | 62/81 |

*Primary Examiner*—Lloyd L. King

*Attorney, Agent, or Firm*—Frank P. Giacalone; Francis H. Boos

[57] ABSTRACT

The present invention relates to a self-contained air conditioning unit including a reversible refrigeration system and more particularly to a control system having a plurality of sensing means that are effective in maintaining operation of the unit in a heat pump mode when the ambient and the surface temperature of selected refrigeration components are above a preselected frosting temperature.

9 Claims, 2 Drawing Figures

HEAT PUMP FROST CONTROL SYSTEM

BACKGROUND OF THE INVENTION

1. Field of the Invention

Self-contained air conditioning units of the reversible type which are adapted to be mounted in the outer wall of an enclosure and utilized for heating the air from the enclosure during the winter and cooling the air from the enclosure during the summer comprises a housing divided into an indoor section and an outdoor section. An indoor heat exchanger is disposed in the indoor section while an outdoor heat exchanger and usually the compressor are located in the outdoor section. The compressor is reversibly connected to the heat exchangers so that the indoor heat exchanger functions as an evaporator when the unit is operating on the cooling cycle and the outdoor heat exchanger functions as the evaporator on the heating cycle. Suitable independent fan means are provided for circulating indoor air over the indoor heat exchanger and outdoor air over the outdoor heat exchanger during operation of the system on either the heating or cooling cycle.

Under certain operating conditions, the outdoor heat exchanger functioning as the evaporator may operate at such a low temperature as to cause the accumulation of a coating or layer of frost thereon. Since such a frost layer operates as a barrier to heat transfer between the evaporator and the air being circulated over the evaporator, the efficiency of the unit is markedly reduced. Also, unless means are provided for interrupting the accumulation of frost, the evaporator can become completely filled with a layer of frost which may eventually cause motor or other damage to the unit.

Accordingly, by the present invention, there is provided a self-contained heat pump including control circuitry including a pair of thermostats comprising sensing elements subjected to both ambient and selected component surface temperatures whereby the operation of the heat pump is maintained as long as the temperature sensed by the thermostat is above a preselected frosting level and is interrupted by the coldest preselected temperature sensed by the elements.

2. Description of the Prior Art

U.S. Pat. No. 3,159,981—Huskey, assigned to the General Electric Company, assignee of the present invention, discloses a self-contained air conditioning unit including a reversible refrigeration system and a control circuitry designed to interrupt the operation of the refrigeration system whenever either the outdoor or indoor heat exchanger attains a frosting temperature and to supply auxiliary heat to an enclosure whenever the operation of the refrigeration system is thus interrupted during a heating cycle. The frost control switch includes a vapor filled bellows and capillary tube sensing element connected to the bellows. The tube is arranged with a first portion in contact with one of the heat exchangers and a second portion in contact with the other heat exchanger whereby the bellows operated switch will stop the compressor when either heat exchanger attains a frosting temperature.

Another prior art attempt at solving the frosting of the outdoor heat exchanger when in the heating cycle it is operating as an evaporator, is disclosed in U.S. Pat. No. 3,466,888—Kyle. The control circuitry includes a first thermistor in heat exchange contact with the outdoor coil and a second thermistor is exposed to the temperature of the outdoor air. The two thermistors are connected in series. When frost forms on the surface of the outdoor heat exchanger, the temperature of the refrigerant therein decreases, and the voltage at the junction of the thermistor changes, and operates a control circuit which stops the fan of the outdoor coil, and reverses the flow of refrigerant so that the outdoor coil operates as a condenser coil to melt the frost.

U.S. Pat. No. 3,348,607—Cootey discloses a split-bulb or dual-bulb thermostat wherein a sensing element is located in the path of return air and the other in the outdoor or ambient air. The sensing elements are proportioned in size relative to each other and both elements transmit motion to a single power element in response to changes in the temperature of the air affecting the elements.

SUMMARY OF THE INVENTION

The present invention relates to a self-contained air conditioning unit for heating and cooling an enclosure. The refrigeration system includes an outdoor heat exchanger, an indoor heat exchanger, a compressor, a valve for selectively connecting the compressor to the heat exchangers whereby the outdoor heat exchanger functions as an evaporator during operation of the unit on the heating cycle and the indoor heat exchanger functions as an evaporator during operation of the unit on the cooling cycle, and air circulating fans including a fan for moving enclosure air through the indoor heat exchanger and a fan for moving outdoor ambient air through the outdoor heat exchanger. More particularly, the invention relates to an air conditioner heating cycle control for preventing excessive frosting of the outdoor heat exchanger by selectively controlling the operation of the refrigeration system.

The control system includes a first thermostat having a vapor filled bellows and a capillary tube sensing element connected to the bellows. One portion of the element is exposed to the surface temperature of the outdoor heat exchanger and another portion of the element is exposed to the ambient outdoor temperature. A switch operable by the bellows is effective in de-energizing the compressor when either of the portions elements senses a preselected frosting temperature, and for energizing a heating element arranged in the air path through the indoor heat exchanger.

A second thermostat similar to the first thermostat has a portion of its element exposed to the suction line temperature adjacent the compressor and another portion of the element exposed to the ambient outdoor temperature. A switch operable if either of the elements senses a preselected frosting temperature is effective to control operation of the outdoor fan through the first thermostat when the switch of the first thermostat is positioned to de-energize the compressor and to control operation of the fan independent of the first thermostat when the ambient and suction line are above a preselected frosting temperature.

DESCRIPTION OF THE PREFERRED EMBODIMENT

Figure 1:
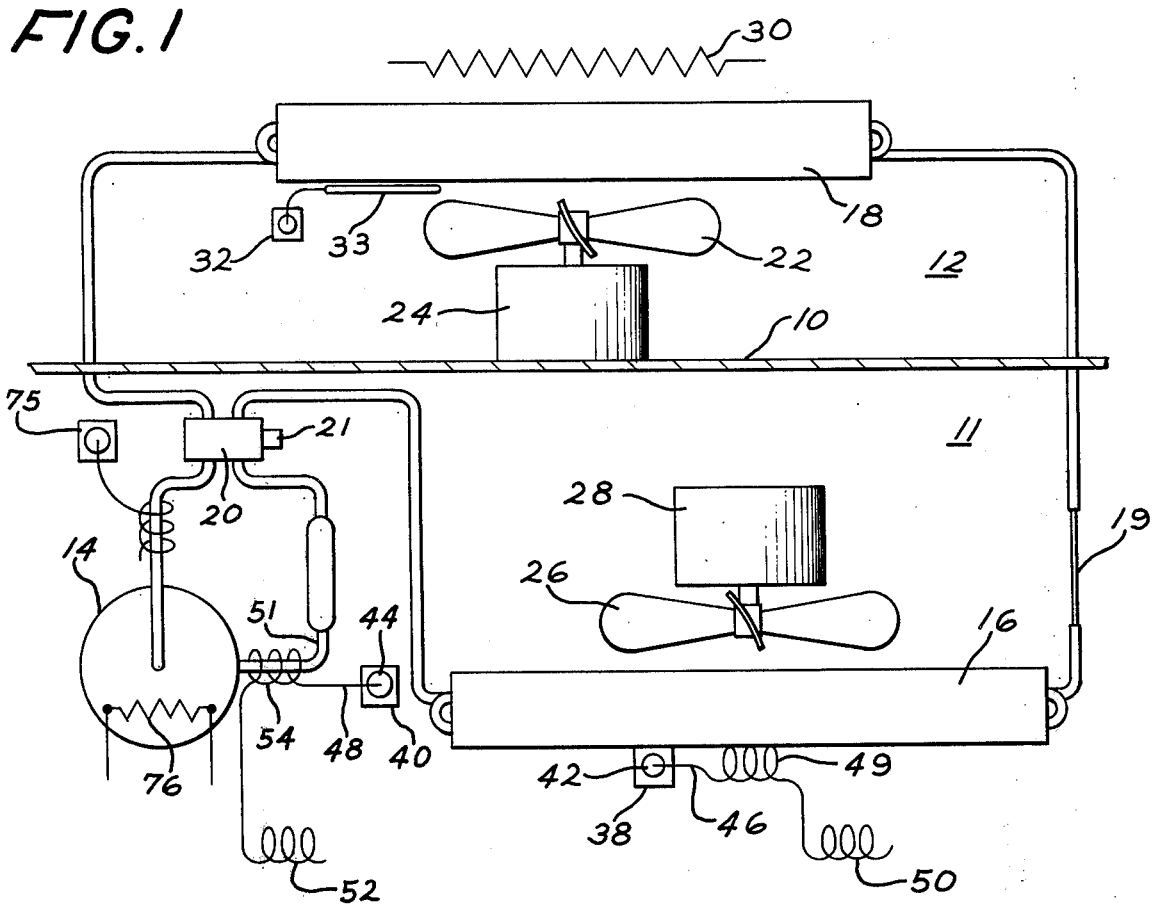
FIG. 1 is a diagrammatic view of a self-contained heat pump air conditioner unit embodying this invention.

Referring to FIG. 1 of the drawing, there is shown schematically an air conditioning refrigeration system of the reversible or heat pump type divided by means of a partition 10 into an outdoor section 11 and an indoor section 12. A reverse cycle refrigeration system comprises a compressor 14 and an outdoor heat exchanger 16 mounted within the outdoor section 11 and an indoor heat exchanger 18 mounted within the indoor section 12. The outdoor heat exchanger 16 and indoor heat exchanger 18 are connected by means of a suitable flow restriction means such as a capillary tube 19 while the compressor is connected to the heat exchangers through a reversing valve 20 operated by a solenoid 21 so that the indoor heat exchanger 18 can be connected to the compressor either as an evaporator or as the condenser component of a refrigeration system. A fan 22 driven by a motor 24 is provided in the indoor section for circulating air over or through the indoor heat exchanger 18 while a fan 26 driven by a motor 28 is provided in the outdoor section for circulating outdoor air over the outdoor heat exchanger 16. An auxiliary heater in the form of an electrical resistance heater 30 is preferably provided in the indoor section in the path of air flowing through the indoor heat exchanger 18 for the purpose of supplying heat to the airstream under certain operating conditions.

Positioned within the unit at some point in the airstream upstream from the heat exchanger 18 is a thermostat 32 which controls the operation of the unit on either the heating or the cooling cycle. This thermostat 32 is of the type well known in the art and includes sensing means 33 responsive to the temperature of the indoor air for actuating a switch in the control circuit in a manner to be fully explained hereinafter. In the illustrated embodiment of the invention this temperature responsive means 33 is arranged in the airstream flowing from the enclosure and into the indoor section. The unit is also provided with a main or selector switch 34 (FIG. 2) through which electrical supply from supply lines 36–37 is connected to the unit and by means of which the operator of the unit may select operation thereof on either the heating or the cooling cycle.

In accordance with the present invention, the unit also includes a pair of frost control thermostats or switches 38 and 40 which may be conveniently mounted on the outdoor section 11 and which are activated by a vapor-filled bellows 42, 44 respectively, and include capillary tube sensing elements 46, 48 connected to the bellows 42, 44 respectively.

The sensing element 46 of switch 38 is arranged to maintain operation of the refrigeration system in the heat pump mode when both the ambient and surface temperature of heat exchanger 16 are both above a preselected frost producing range, and to interrupt the operation of the compressor 14 whenever either heat exchanger 16 or the ambient outdoor temperature creates an excessive frosting condition or temperature during operating of the unit on the heating cycle. To this end, the capillary sensing element 46 is arranged so that it includes a first portion 49 which continuously senses the temperature of the outdoor heat exchanger 16 and a second portion 50 which continuously senses the outdoor or ambient temperature.

The sensing element 48 of switch 40 is arranged to maintain operation of the outdoor fan motor 28 when the temperature of the suction line 51 adjacent the compressor 14 and the ambient outdoor temperature are both above the frost producing range, and to interrupt operation of the fan 28 when either suction line 51 or ambient temperature creates a frosting condition or temperature, when the unit is on the heating cycle and control 38 has interrupted operation of the compressor 14. To this end, the capillary sensing element 48 is arranged so that it includes a first portion 52 which continuously senses the outdoor or ambient temperature on a second portion 54 which continuously senses the temperature of the suction line 51 adjacent the compressor 14.

As is well known, a vapor-filled capillary-bellows type of thermostat has the characteristic of controlling from the coldest point of the bellows-capillary system due to the fact that a vapor-liquid boundary is formed at the coldest point and this boundary establishes the vapor pressure of the capillary-bellows system. Hence, the operation of the frost control switch 38 will be controlled by either of its sensing portions 49, 50 depending on which is colder, while the operation of the frost control switch 40 will be controlled by either of its sensing portions 52, 54 depending on which is colder. While in the preferred embodiment of the invention disclosed, vapor-filled capillary-bellows type thermostat controls have been used successfully, it should be understood that other controls and components may be employed that provide control from the coldest point sensed.

Figure 2:
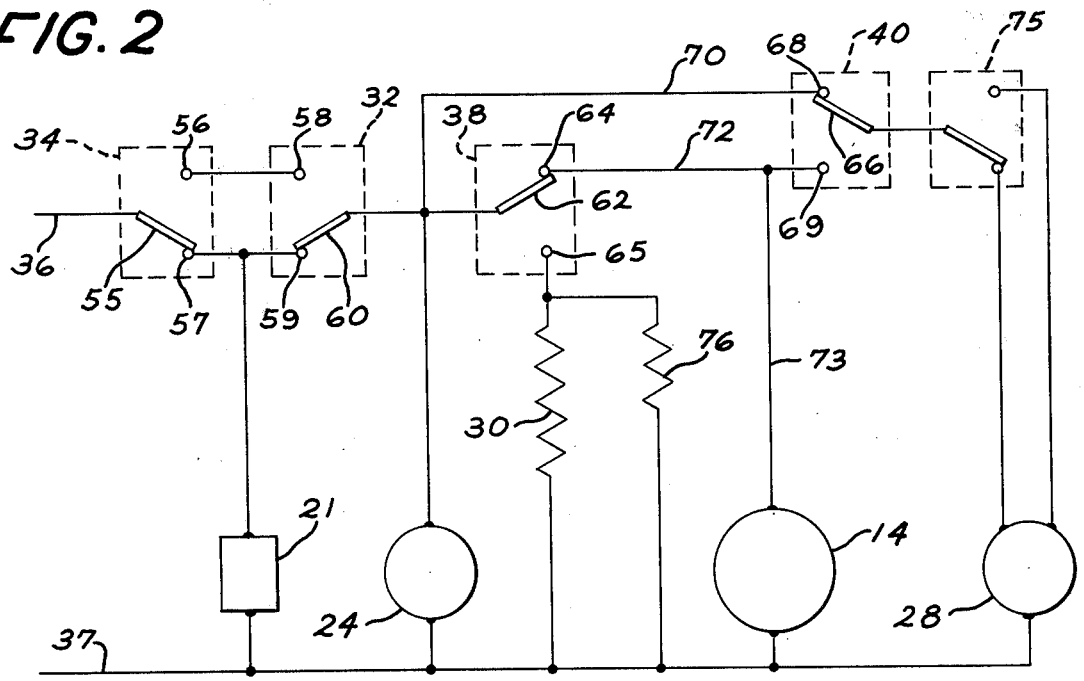
FIG. 2 is a simplified schematic diagram of electrical control circuitry adapted to control the unit in accordance with the present invention.

For a more complete understanding of the control circuitry and the manner in which frost buildup is controlled, reference is made to the wiring diagram shown in FIG. 2 of the drawing. As mentioned hereinbefore, the main or selector switch 34 allows energization of the air conditioning unit, and selects the operation thereof on either the heating or cooling cycle. Switch 34 includes switching means 55 movable between a cooling contact 56 and a heating contact 57 by which the operation of the unit on either the cooling cycle or the heating cycle can be selected.

In operation with the selector switch 34 in the heat position, a circuit is completed from line 36 through solenoid 21 to activate the reversing valve 20 thereby placing the refrigeration system in the heat pump mode. Cooling contact 56 and heating contact 57 of selector switch 34 are connected to cooling and heating contacts 58, 59 respectively, of thermostat 32. Accordingly, the switching means 60 of thermostat 32 is arranged to supply power to the remaining control circuit through contact 58 in the cooling mode and contact 59 in the heating mode.

Power from supply line 36 passes through switch means 60 to the switching means 62 of the frost control 38 which is arranged to move between an upper temperature contact 64 and a lower temperature contact 65. It should be noted that the indoor fan 24 will run continuously during operation of the unit on either the heating or the cooling cycle under control of the thermostat 32. The switching means 66 of frost control 40 which controls the operation of the outdoor fan motor 28 is arranged to move between an upper temperature contact 68 and a lower temperature contact 69. Accordingly, power is supplied to contact 68 from thermostat 32 through line 70, while contact 69 receives power from contact 64 of control 38 through line 72.

In operation, when the ambient or outdoor temperature sensed by portion 50, and the surface temperature of heat exchanger 16 sensed by portion 49 of capillary 46 are both above a preselected upper or frost producing temperature, a circuit is completed through control 38, switch means 62, contact 64, lines 72, 73 and compressor 14, to energize the refrigeration system in the heat pump mode. In the event that the ambient or outdoor temperature sensed by portion 52 and the temperature of the suction line 51 adjacent the compressor 14 sensed by portion 54 of capillary 48 are both above a preselected upper or frost producing temperature, a circuit is completed from line 70, contact 68, switch means 66, fan speed selector 75, to energize the outdoor fan motor 28. While the present embodiment of the control circuit includes a fan speed selector 75 capable of modulating between a high and low fan speed, determined by compressor outlet line temperature, it should be noted that the frost control system of the present invention is not dependent on modulating the outdoor fan speed and accordingly the use of a fan speed selector switch is optional.

In the event either portion 49 or 50 of capillary 46 senses a predetermined low frost producing temperature, the bellows 42 will cause the switching means 62 to move from contact 64 to contact 65. The circuit to the compressor 14 will be broken thereby de-energizing the refrigeration circuit to prevent frost from forming on heat exchanger 16 while at the same time completing a circuit through heater 30 to maintain the comfort level selected by thermostat 32. If, during the time the control 38 is positioned by a frosting temperature to de-energize the compressor 14, either of the portions 52, 54 of capillary 48 sense a low frost producing temperature, the bellows 44 will cause switching means 66 of switch 40 to move from contact 68 to contact 69, so that the outdoor fan will be de-energized.

It should be noted that the surface temperature of the heat exchanger 16 and suction line 51 adjacent the compressor 14 will normally be colder than ambient when the unit is operating in the heat pump mode. Accordingly, portions 49 and 54 will sense the frost producing temperature and in effect be the controlling point. With regard to the operation of outdoor fan motor 28, the portion 54 sensing the colder suction line temperature has caused switching means 66 to de-energize the fan motor 28. In this situation the relatively warm operating temperatures of the compressor 14 will migrate or be transferred to the suction line 51 so that the temperature sensed by portion 54 will very quickly be above the frost producing level causing switch means 66 to switch to contact 68 and once again energize fan motor 28 to raise the temperature of heat exchanger 16 relative to ambient to eliminate any frost that may have collected on the surface of heat exchanger 16. This warming of suction line 51 may be assisted when a sump heater 76 is employed. It should be noted that the heater 76 is energized with the heater 30 when compressor 14 is de-energized. The operation of the outdoor fan 26 at this time is beneficial in that by raising the surface temperature of the heat exchanger so that the surface temperature of heat exchanger 16 is once again above the preselected frost producing temperature, causing switch means 62 to move to contact 64 so that the compressor 14 will be energized and the refrigeration system will operate in the heat pump mode to maintain the comfort level selected by the thermostat 32.

While operation of the control circuit of the present invention is controlled by the upper and lower temperatures sensed by the capillaries 46 and 48, it should be noted, however, that the exact temperatures selected may vary depending on several factors, including geographic location of the unit and the exact location of the portions 49 and 54 relative to the refrigeration components. The frost control system of the present invention has been successfully carried out when the temperature range of control 38 was between a high of 35° F. and a low of 10° F. with a temperature swing of 25° F., and the temperature range of control 40 was between a high of 35° F. and a low of 20° F., with a temperature swing of 15° F.

In summary, the switching means 62 will complete a circuit through contact 64 when both the surface temperature of heat exchanger 16 and the ambient air above 35° F. and will switch to contact 65 to de-energize the compressor if either gets down to 10° F., keeping in mind, however, that the surface temperature of heat exchanger 16 will be the lower than ambient. With regard to switching means 66, a circuit to the fan motor 28 will be completed through contact 68 when both the surface temperature of suction line 51 and the ambient are above 35° F. and will switch to contact 69 if either gets down to 25° F. to de-energize the fan motor 28 only if control 38 has sensed a frost producing 10° F. temperature. If control 38 has not sensed a frost producing temperature then the fan motor will continue to operate through line 72.

It should be apparent to those skilled in the art that the embodiment described heretofore is considered to be the presently preferred form of this invention. In accordance with the patent statutes, changes may be made in the disclosed apparatus and the manner in which it is used without actually departing from the true spirit and scope of this invention.

What is claimed is:

1. In a self-contained air conditioning unit for heating and cooling an enclosure, an outdoor heat exchanger and indoor heat exchanger, a compressor, means for selectively connecting said compressor to said heat exchangers whereby said outdoor heat exchanger functions as an evaporator during operation of said unit on the heating cycle and said indoor heat exchanger functions as an evaporator during operation of said unit on the cooling cycle, fan means for moving enclosure air through said indoor heat exchanger, fan means for moving outdoor ambient air through said outdoor heat exchanger, an air conditioner heating cycle control system comprising:

a first control means including a sensing element having one portion being exposed to the surface temperature of said outdoor heat exchanger and a second portion being exposed to the ambient outdoor temperature, means under control of said portions for maintaining operation of said compressor in the heating cycle when both ambient and said heat exchanger surface temperature sensed by said portions are above a preselected frost producing temperature and to de-energize said compressor when either of said portions senses a preselected frost producing temperature;

a second control including a sensing element having one portion being exposed to the suction line temperature adjacent said compressor and a second portion being exposed to said ambient outdoor temperature, means under control of said portions for maintaining operation of said outdoor fan independent of said first control when both ambient and the suction line surface temperature sensed by said portions are above a preselected frost producing temperature and to complete a circuit to said fan through said first control if either of the portions of said second control senses a preselected frosting temperature to de-energize said outdoor fan means when said compressor is de-energized.

2. A self-contained air conditioning unit as recited in claim 1, further comprising, a heating means arranged in the path of air through said indoor heat exchanger being energized when the switch means of said first control is in its second position.

3. A self-contained air conditioning unit as recited in claim 1, wherein said first control means includes a vapor-filled bellows and a capillary tube sensing element connected to said bellows having one portion of the capillary being exposed to the surface temperature of the outdoor heat exchanger and a second portion of the capillary being exposed to ambient outdoor temperature.

4. A self-contained air conditioning unit as recited in claim 3, wherein said second control means includes a vapor-filled bellows and a capillary tube sensing element connected to said bellows having one portion of the capillary being exposed to the surface temperature of the suction line adjacent the compressor and a second portion of the capillary being exposed to ambient outdoor temperature.

5. A self-contained air conditioning unit as recited in claim 4, further comprising, a heating means arranged in the path of air through said indoor heat exchanger being energized when the switch means of said first control is in its second position.

6. A self-contained air conditioning unit as recited in claim 3 wherein said first control means includes a switch means operable by said bellows to a first position for maintaining operation of said compressor and to a second position for de-energizing said compressor.

7. A self-contained air conditioning unit as recited in claim 4 wherein said second control means includes a switch means operable by said bellows to a first position to maintain operation of said outdoor fan independent of said first control and to a second position for operating said fan through said first control means when its switch means is in its second position.

8. A method of controlling the heating operation of a self-contained air conditioning unit for heating and cooling an enclosure, an outdoor heat exchanger and indoor heat exchanger, a compressor, means for selectively connecting said compressor to said heat exchangers whereby said outdoor heat exchanger functions as an evaporator during operation of said unit on the heating cycle and said indoor heat exchanger functions as an evaporator during operation of said unit on the cooling cycle, fan means for moving enclosure air through said indoor heat exchanger, fan means for moving outdoor ambient air through said outdoor heat exchanger comprising:

a. a first control means for:
   1. sensing the surface temperature of said outdoor heat exchanger and the ambient outdoor temperature with a first control means;
   2. maintaining operation of said unit in the heating cycle when both ambient and said heat exchanger surface temperature are above a preselected frost producing temperature;
   3. de-energizing said compressor when either the heat exchanger or ambient is at a preselected frost producing temperature;

b. a second control means for:
   1. sensing the suction line temperature adjacent said compressor and said ambient outdoor temperature with a second control means;
   2. maintaining operation of said outdoor fan independent of said first control means when both ambient and the suction line surface temperature are above a preselected frost producing temperature;
   3. de-energizing said outdoor fan means if either the suction line or ambient is at a preselected frosting temperature when said compressor is de-energized.

9. The method recited in claim 8 further comprising: energizing a heating means arranged in the path of air through said indoor heat exchanger when said compressor is de-energized.

* * * * *